US010108136B2

(12) United States Patent
Yamashita et al.

(10) Patent No.: US 10,108,136 B2
(45) Date of Patent: Oct. 23, 2018

(54) TONER COLLECTION DEVICE COLLECTING FLOATING TONER AND IMAGE FORMING APPARATUS INCLUDING TONER COLLECTING DEVICE

(71) Applicant: KYOCERA Document Solutions Inc., Osaka (JP)

(72) Inventors: Kazuya Yamashita, Osaka (JP); Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/626,191

(22) Filed: Jun. 19, 2017

(65) Prior Publication Data

US 2018/0032024 A1 Feb. 1, 2018

(30) Foreign Application Priority Data

Jul. 27, 2016 (JP) ..... 2016-147224

(51) Int. Cl.

| | |
|---|---|
| ***G03G 15/08*** | (2006.01) |
| ***G03G 21/00*** | (2006.01) |
| ***G03G 21/10*** | (2006.01) |
| ***G03G 21/12*** | (2006.01) |
| ***G03G 21/20*** | (2006.01) |

(52) U.S. Cl.

CPC ..... *G03G 21/10* (2013.01); *G03G 21/206* (2013.01); *G03G 15/0815* (2013.01); *G03G 15/0844* (2013.01); *G03G 15/0896* (2013.01); *G03G 21/0052* (2013.01); *G03G 21/0076* (2013.01); *G03G 21/0082* (2013.01); *G03G 21/105* (2013.01); *G03G 21/12* (2013.01); *G03G 2221/0021* (2013.01); *G03G 2221/0089* (2013.01); *G03G 2221/0094* (2013.01)

(58) Field of Classification Search

CPC ..... G03G 15/0815; G03G 15/0844; G03G 15/0896; G03G 15/0898; G03G 21/0052; G03G 21/0076; G03G 21/0082; G03G 21/10; G03G 21/105; G03G 21/12; G03G 21/206; G03G 2221/0021; G03G 2221/0089; G03G 2221/0094

See application file for complete search history.

(56) References Cited

U.S. PATENT DOCUMENTS 6,108,511 A * 8/2000 Kutsuwada ..... G03G 21/10 399/253

2015/0212486 A1* 7/2015 Wachi ..... G03G 21/206 399/93

FOREIGN PATENT DOCUMENTS

JP 2014-235193 A 12/2014

* cited by examiner

*Primary Examiner* — Joseph S Wong

(74) *Attorney, Agent, or Firm* — Studebaker & Brackett PC

(57) ABSTRACT

A toner collecting device includes an exhaust path and a catching installation. Through the exhaust path, air containing a floating toner is passed. The catching installation is configured to catch the floating toner from the air passing through the exhaust path. The catching installation is formed by overlapping a plural of filters each having a different mesh size.

9 Claims, 10 Drawing Sheets

TONER COLLECTION DEVICE COLLECTING FLOATING TONER AND IMAGE FORMING APPARATUS INCLUDING TONER COLLECTING DEVICE

INCORPORATION BY REFERENCE

This application is based on and claims the benefit of priority from Japanese Patent application No. 2016-147224 filed on Jul. 27, 2016, which is incorporated by reference in its entirety.

BACKGROUND

The present disclosure relates to a toner collecting device which collects a scattered toner and an image forming apparatus including the toner collecting device.

In an electrophotographic type image forming apparatus, such as a copying machine, a printer and a facsimile, a powder developer is mainly used. An electrostatic latent image formed on an image carrier such as a photosensitive drum is visualized into a toner image with the developer (a toner) supplied from a developing device. The toner image is transferred on a sheet directly or via an image carrier such as an intermediate transferring belt, and then subjected to a fixing processing.

When the electrostatic latent image is visualized into the toner image by the developing device, a part of the toner is sometimes scattered, leaks out from the developing device and contaminates an inside of the image forming apparatus. Then, the image forming apparatus may be provided with a toner collecting device. The toner collecting device includes a suction duct connectable to the developing device and a sucking unit, and is configured such that air containing the toner (the floating toner) scattered in the inside of the developing device is sucked through the suction duct by the sucking device, the floating toner is caught by a filter from the sucked air and then collected. The toner collecting device is provided with a vibrating member which vibrates the filter in order to prevent clogging of the filter.

However, even in the above described toner collecting device, a long period of use causes the clogging of the filter to decrease floating toner collecting efficiency of the filter. Alternatively, in order to keep a suction air volume constant for a long period, a filter having a large mesh size is sometimes used. However, if the filter has a large mesh size, it becomes difficult to catch the floating toner surely. As a result, the floating toner penetrating through the filter may enter the sucking device to deteriorate floating toner sucking performance of the sucking device. In addition, the floating toner penetrating through the filter may leak out from the image forming apparatus.

SUMMARY

In accordance with an aspect of the present disclosure, a toner collecting device includes an exhaust path and a catching installation. Through the exhaust path, air containing a floating toner is passed. The catching installation is configured to catch the floating toner from the air passing through the exhaust path. The catching installation is formed by overlapping a plural of filters each having a different mesh size.

In accordance with an aspect of the present disclosure, an image forming apparatus includes an image forming part and the above described a toner collecting device. The image forming part is configured to form an image. The toner collecting device collects a waste toner discharged from the image forming part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a waste toner collecting device and an image forming apparatus according to an embodiment of the present disclosure will be described.

Figure 1:
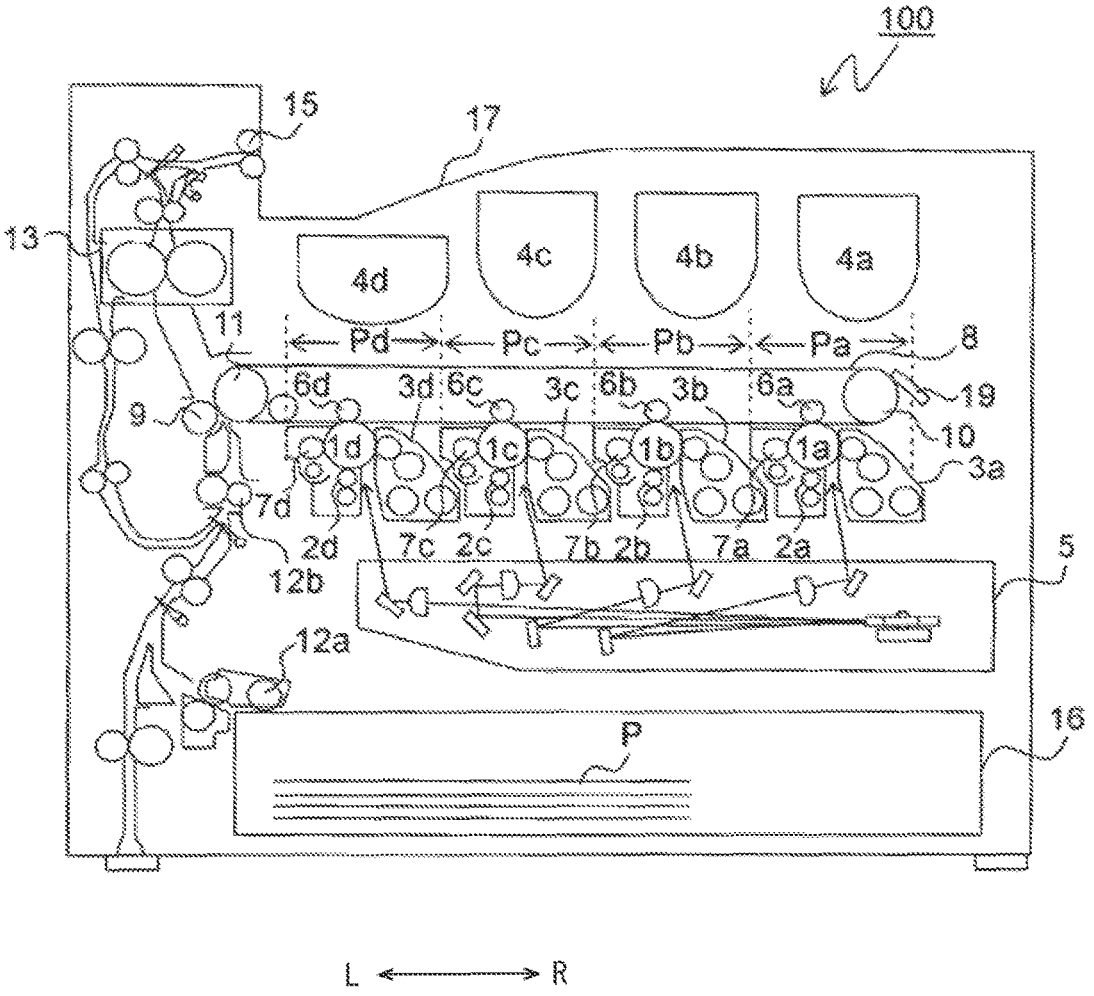
FIG. 1 is a front view showing a structure of an image forming apparatus according to an embodiment of the present disclosure.
Figure 2:
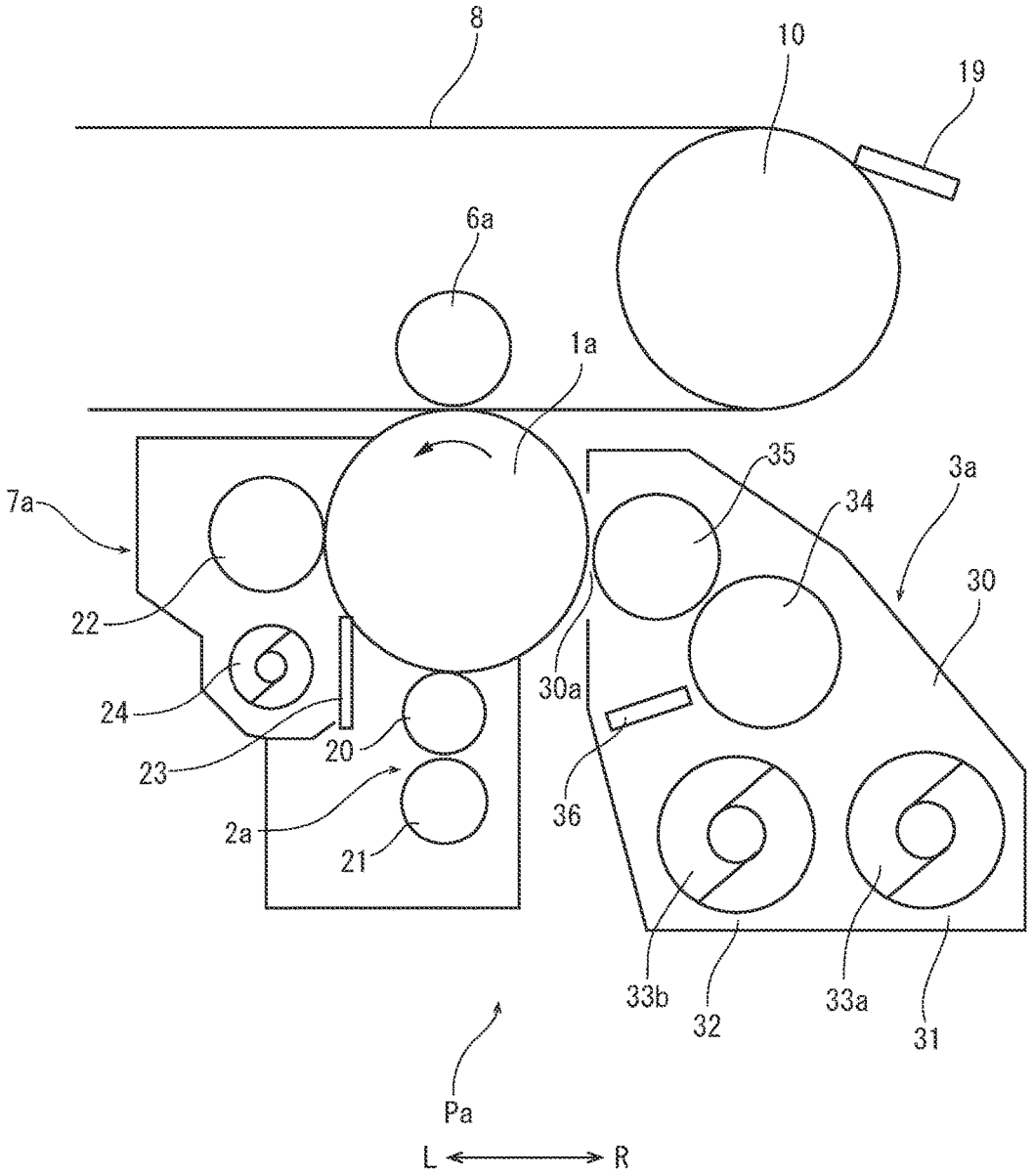
FIG. 2 is a front view showing an image forming part of the image forming apparatus according to the embodiment of the present disclosure.

With reference to FIG. 1 and FIG. 2, the image forming apparatus 100 according to an embodiment of the present disclosure will be described. FIG. 1 is a sectional view showing a structure of the image forming apparatus 100 and FIG. 2 is a sectional view showing a structure of an image forming part Pa. The image forming apparatus 100 is a quadruple tandem type color printer including four image forming parts Pa, Pb, Pc and Pd which are adjacently arranged side by side and form a full color image. The four image forming parts Pa, Pb, Pc and Pd respectively correspond to four different colors (magenta, cyan, yellow and black). In the following description, a near side of a paper plan of FIG. 1 shows a front side of the image forming apparatus 100, and a left-right direction is based on a direction in which the image forming apparatus 100 is seen from the front side.

In an apparatus main body of the image forming apparatus 100, the four image forming parts Pa to Pd are adjacently arranged in the order from the right side of FIG. 1. These image forming parts Pa to Pd respectively form images of magenta, cyan, yellow and black.

In these image forming parts Pa to Pd, photosensitive drums 1*a*, 1*b*, 1*c* and 1*d* are respectively provided in a rotatable manner in the counterclockwise direction in FIG. 1. The photosensitive drums 1*a* to 1*d* each are an example of an image carrier which carries a visible image (a toner image) of each color. Above the photosensitive drums 1*a* to 1*d*, an intermediate transferring belt 8 is supported between a driven roller 10 and a driving roller 11 so as to circulate. The intermediate transferring belt 8 is an example of an image carrier which carries a visible image (a toner image) formed by overlapping the visible image of each color. In an inner hollow space of the intermediate transferring belt 8, primary transferring rollers 6*a*, 6*b*, 6*c* and 6*d* are rotatably supported while opposing the photosensitive drums 1*a* to 1*d* via the intermediate transferring belt 8. The primary transferring rollers 6*a*, 6*b*, 6*c* and 6*d* are examples of transferring devices which transfer the toner image from the respective photosensitive drums 1*a* to 1*d* to the intermediate transferring belt 8. At the left side of the driving roller 11, a secondary transferring roller 9 is rotatably supported while opposing the driving roller 11 via the intermediate transferring belt 8. The secondary transferring roller 9 is an example of a transferring device which transfers the toner image from the intermediate transferring belt 8 to a sheet P.

On a downstream side of the secondary transferring roller 9 in a rotation direction of the intermediate transferring belt 8 (near the driven roller 10 in this embodiment), a belt cleaning device 19 configured to remove the toner and the like remained on the intermediate transferring belt 8 is disposed. The belt cleaning device 19 has a blade and a collection part. The blade comes into contact with the intermediate transferring belt 8 from a counter direction to the rotation direction of the intermediate transferring belt 8. The toner removed by the blade is collected in the collection part. The toner collected in the collection part is conveyed toward the front side of the image forming apparatus 100 by a collection spiral or the like. On a front face of the collection part, a discharge opening (not shown) through which the conveyed toner is discharged is formed.

The sheet P on which the toner image is to be transferred is stored in a sheet feeding cassette 16 provided in a lower portion of the apparatus main body. The sheet P is conveyed to the secondary transferring roller 9 via a feed roller 12*a* and a registration roller pair 12*b*.

Next, the image forming parts Pa to Pd will be described. In the image forming parts Pa to Pd, charging devices 2*a*, 2*b*, 2*c* and 2*d*, developing devices 3*a*, 3*b*, 3*c* and 3*d* and drum cleaning devices 7*a*, 7*b*, 7*c* and 7*d* are respectively disposed around the photosensitive drums 1*a* to 1*d*. The charging devices 2*a* to 2*d* charge the photosensitive drums 1*a* to 1*d* respectively. The developing devices 3*a* to 3*d* develop electrostatic latent images formed on the respective photosensitive drums 1*a* to 1*d* with the toner. The drum cleaning devices 7*a* to 7*d* remove and collect the developer (the toner) remained on the respective photosensitive drums 1*a* to 1*d* after the toner images are transferred. Below the image forming parts Pa to Pd, an exposing unit 5 is disposed. The exposing unit 5 performs exposing to the photosensitive drums 1*a* to 1*d* according to an image data.

Next, an image forming operation will be described. When the image data is input from an image input device such as a personal computer, the charging devices 2*a* to 2*d* charge the surfaces of the respective photosensitive drums 1*a* to 1*d* uniformly, and then the exposing unit 5 performs the exposing to the photosensitive drums 1*a* to 1*d* according to the input image data to form electrostatic latent images corresponding to the input image data on the photosensitive drums 1*a* to 1*d*. The electrostatic latent images are developed by the developing devices 3*a* to 3*d* into toner images of corresponding colors. Then, by applying a predetermined transferring voltage between the primary transferring rollers 6*a* to 6*d* and the respective photosensitive drums 1*a* to 1*d*, the toner images of magenta, cyan, yellow and black colors are primary-transferred on the intermediate transferring belt 8. After that, in order to prepare for formation of next new electrostatic latent images on the photosensitive drums 1*a* to 1*d*, the toner remained on the surfaces of the photosensitive drums 1*a* to 1*d* are removed by the respective drum cleaning devices 7*a* to 7*d*. If a ratio of the toner to the two component developer filled in each of the developing devices 3*a* to 3*d* is lower than a predetermined value by the image forming operation described later, the toner is supplied from toner containers 4*a* to 4*d*, as developer containers, to the respective developing devices 3*a* to 3*d*.

The toner images formed on the photosensitive drums 1*a* to 1*d* are sequentially transferred on the intermediate transferring belt 8 and then a full color toner image is secondary-transferred on the sheet P by the secondary transferring roller 9. The full color toner image is heated and pressed at a fixing device 13 to be fixed on the sheet P. The sheet P on which the full color toner image has been fixed is ejected by an ejection roller pair 15 on the ejection tray 17.

Figure 3:
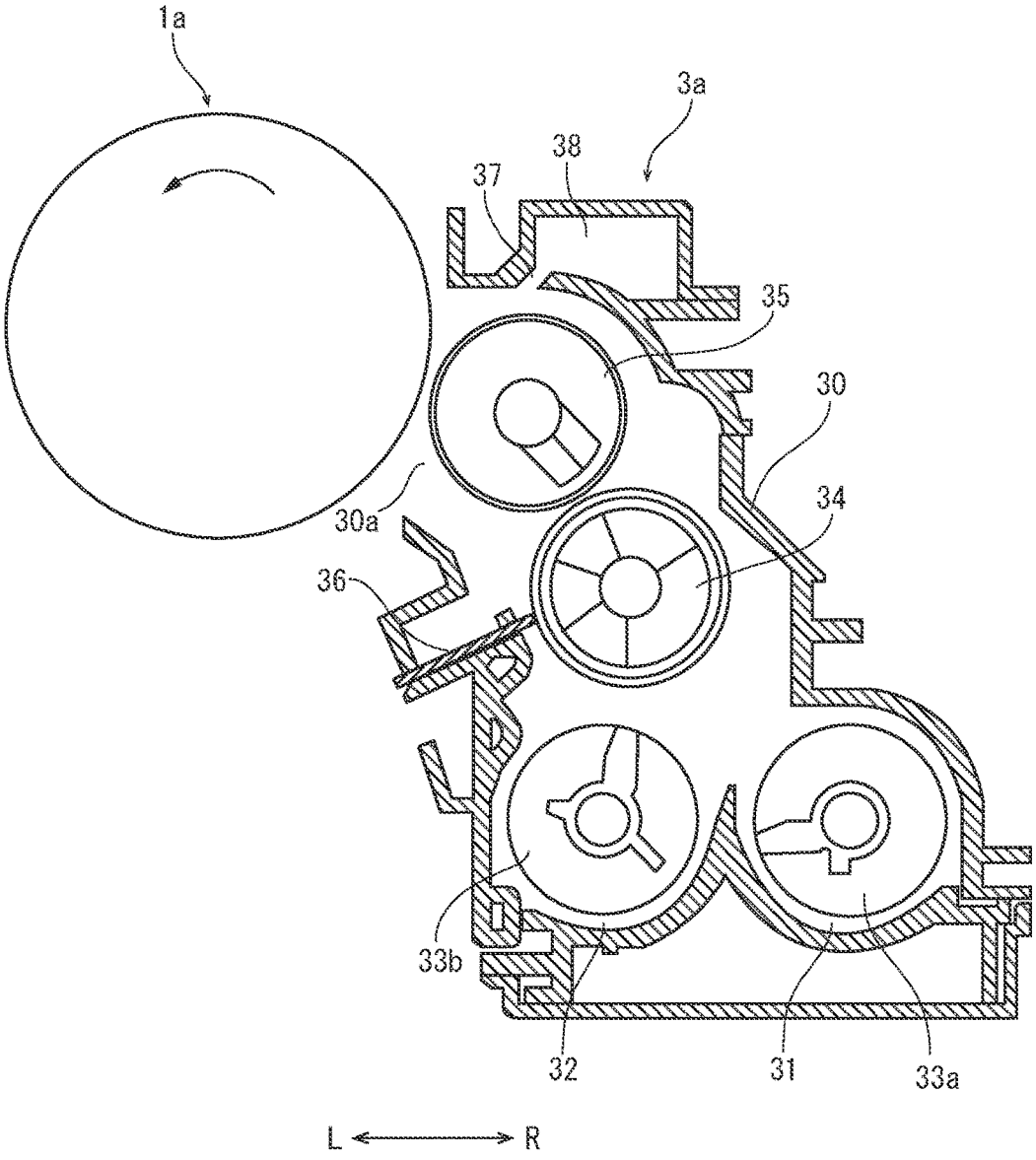
FIG. 3 is a front sectional view showing a structure of a developing device of the image forming apparatus according to the embodiment of the present disclosure.

Next, with reference to FIG. 2 and FIG. 3, the image forming part Pa described above will be described. FIG. 3 is a sectional view showing the developing device 3*a*. The image forming parts Pb to Pd each have the substantially same structure as the image forming part Pa, and their detail descriptions are omitted. Around the photosensitive drum 1*a*, the charging device 2*a*, the developing device 3*a*, the primary transferring roller 6*a* and the cleaning device 7*a* described above are arranged along the rotation direction of the photosensitive drum 1*a* (the counterclockwise direction in FIG. 2).

The charging device 2*a* has a charging roller 20 and a charging cleaning roller 21. The charging roller 20 comes in contact with the photosensitive drum 1*a* and applies a charging voltage on the surface of the photosensitive drum 1*a*. The charging cleaning roller 21 cleans the charging roller 20.

The developing device 3*a* has a developer container 30 in which the two component developer containing a magnetic carrier and a toner is contained, as shown in FIG. 3. The developer container 30 has an opening 30*a* formed at a portion opposing to the photosensitive drum 1*a*. The developer container 30 has a floating toner duct 38 extending in the front-rear direction above the opening 30*a*. The floating toner duct 38 is communicated with an inside of the developer container 30 via a suction opening 37 formed inside the opening 30*a*. In a lower portion of the developer container 30, an agitating/conveying chamber 31 to which the toner is replenished from the toner container 4*a* and a supplying/conveying chamber 32 are formed. The developer container 30 has a waste developer discharge opening (not shown) through which an excessive developer is discharged.

In the agitating/conveying chamber 31 and the supplying/conveying chamber 32, an agitating/conveying screw 33*a* and a supplying/conveying screw 33*b* are rotatably disposed respectively. The agitating/conveying screw 33*a* and the supplying/conveying screw 33*b* mix the replenished toner with the magnetic carrier, agitate them and charge the toner. In the developer container 30, a magnetic roller 34 and a development roller 35 are disposed. The magnetic roller 34 is positioned above the supplying/conveying screw 33*b* so as to opposite to the supplying/conveying screw 33*b*. The development roller 35 is positioned at the left upper oblique side of the magnetic roller 34 so as to opposite to the magnetic roller 34. A part of an outer circumferential face of the development roller 35 is exposed through the opening 30*a* and opposes to the photosensitive drum 1*a*. The magnetic roller 34 and the development roller 35 are rotated in the clockwise direction in FIG. 3.

On an upstream side of the opposing area of the development roller 35 and the magnetic roller 34 in a rotation direction of the magnetic roller 34, a regulating blade 36 is attached along a length direction of the magnetic roller 34 (a perpendicular direction to the paper plan of FIG. 2). Between a tip edge of the regulating blade 36 and an outer circumferential face of the magnetic roller 34, a small gap is formed.

The developer is agitated while circulating between the agitating/conveying chamber 31 and the supplying/conveying chamber 32 in the developer container 30 by the agitating/conveying screw 33*a* and the supplying/conveying screw 33*b*. This charges the toner. The developer containing the charged toner is conveyed to the magnetic roller 34 by the supplying/conveying screw 33*b* to form a magnetic brush around the magnetic roller 34. A thickness of the magnetic brush is regulated by the regulating blade 36. The magnetic brush of which the thickness has been regulated is conveyed to the opposing area of the magnetic roller 34 and the development roller 35. At the opposing area, the magnetic brush forms a toner layer on the development roller 35 by voltage difference between a DC voltage applied to the magnetic roller 34 and a DC voltage applied to the development roller 35 and magnetic field generated by the magnetic roller 34.

The toner layer formed on the development roller 35 is conveyed by the rotation of the development roller 35 to the opposing area where the photosensitive drum 1*a* and the development roller 35 are opposite to each other. Because the predetermined voltage is applied to the development roller 35, the toner fries from the development roller 35 to the photosensitive drum 1*a* owing to voltage difference between the development roller 35 and the photosensitive drum 1*a*, and develops the electrostatic latent image on the photosensitive drum 1*a*.

With reference to FIG. 2 again, the drum cleaning device 7*a* has a rubbing roller 22, a cleaning blade 23 and a collection spiral 24.

The rubbing roller 22 comes into pressure contact with the photosensitive drum 1*a* at a predetermined pressure. The cleaning blade 23 is supported on a downstream side of the contact portion of the rubbing roller 22 and the photosensitive drum 1*a* in the rotation direction of the photosensitive drum 1*a*, and comes into contact with the photosensitive drum 1*a* from a counter direction to the rotation direction of the photosensitive drum 1*a*. The collection spiral 24 conveys the toner removed from the surface of the photosensitive drum 1*a* by the rubbing roller 22 and the cleaning blade 23 to the front side of the image forming apparatus 100. On a front face of the drum cleaning device 7*a*, a discharge opening (not shown) through which the conveyed toner is discharged is formed.

The image forming apparatus 100 further includes a waste toner collecting device 40 (refer to FIG. 4) which collects the toner removed by the drum cleaning devices 7*a* to 7*d*, the toner removed by the belt cleaning device 19, the floating toner existing near the development rollers 35 of the developing devices 3*a* to 3*d* and the excessive developer in the developing devices 3*a* to 3*d*.

Figure 4:
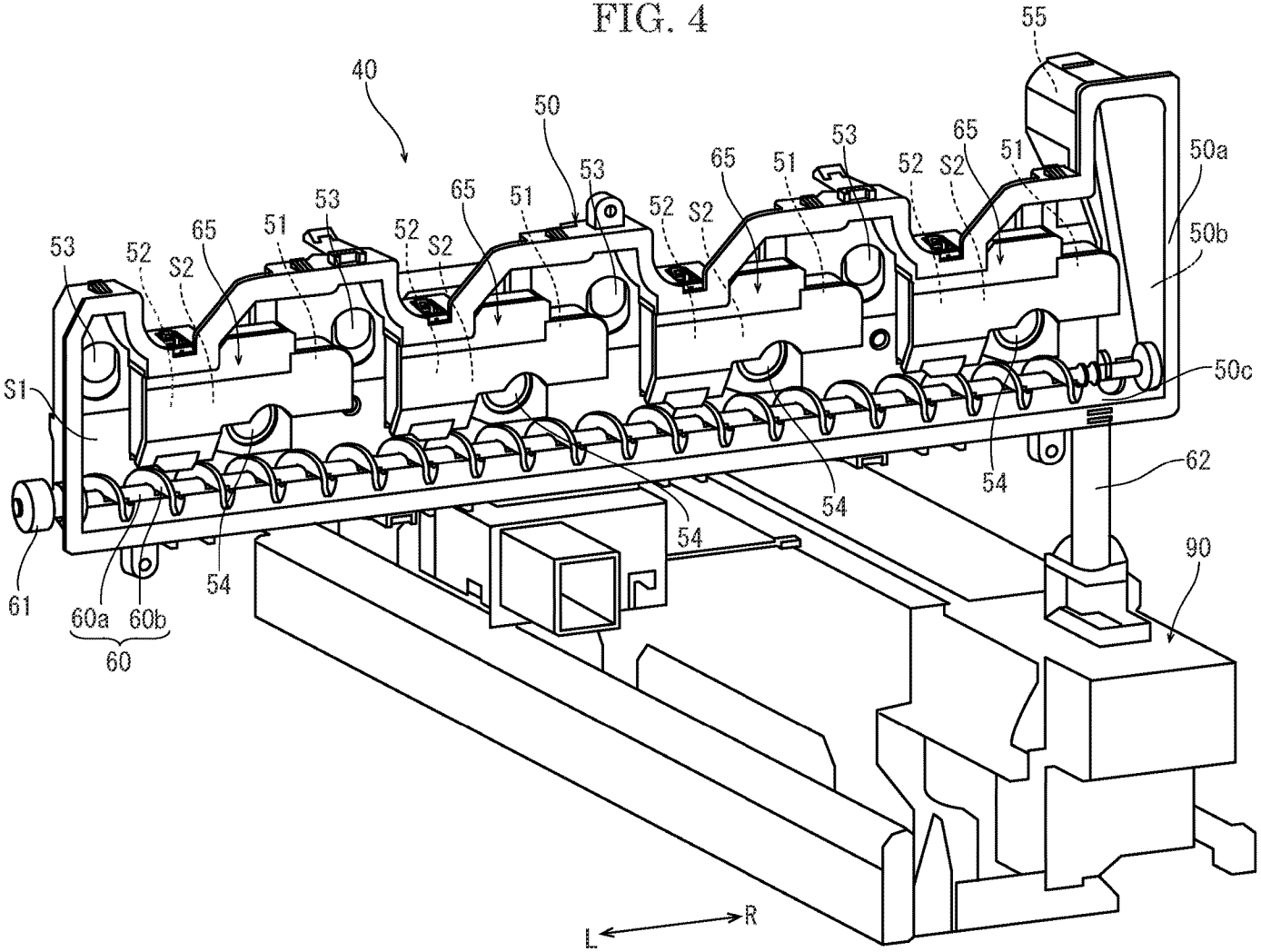
FIG. 4 is a front side perspective view showing a toner collecting device according to an embodiment of the present disclosure.
Figure 5:
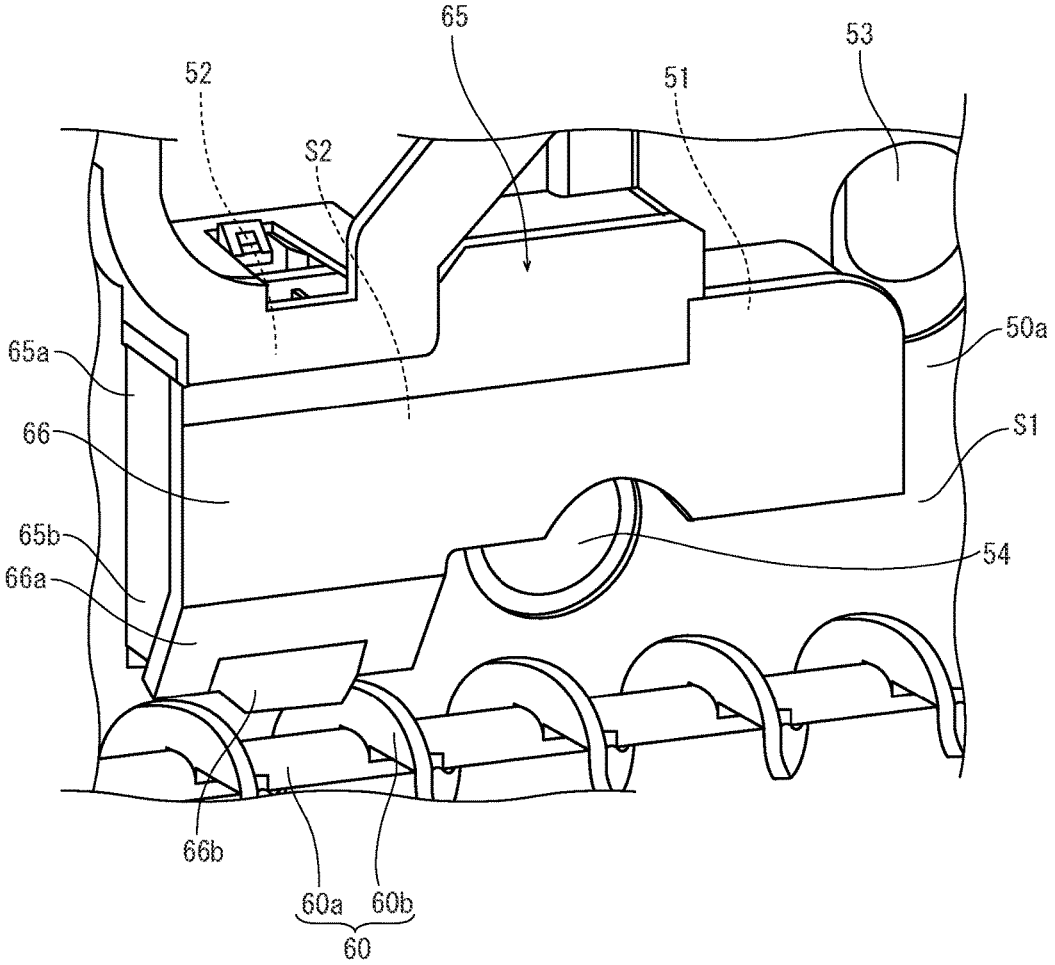
FIG. 5 is a front side perspective view showing a floating toner collection chamber, in the toner collecting device according to the embodiment of the present disclosure.
Figure 6:
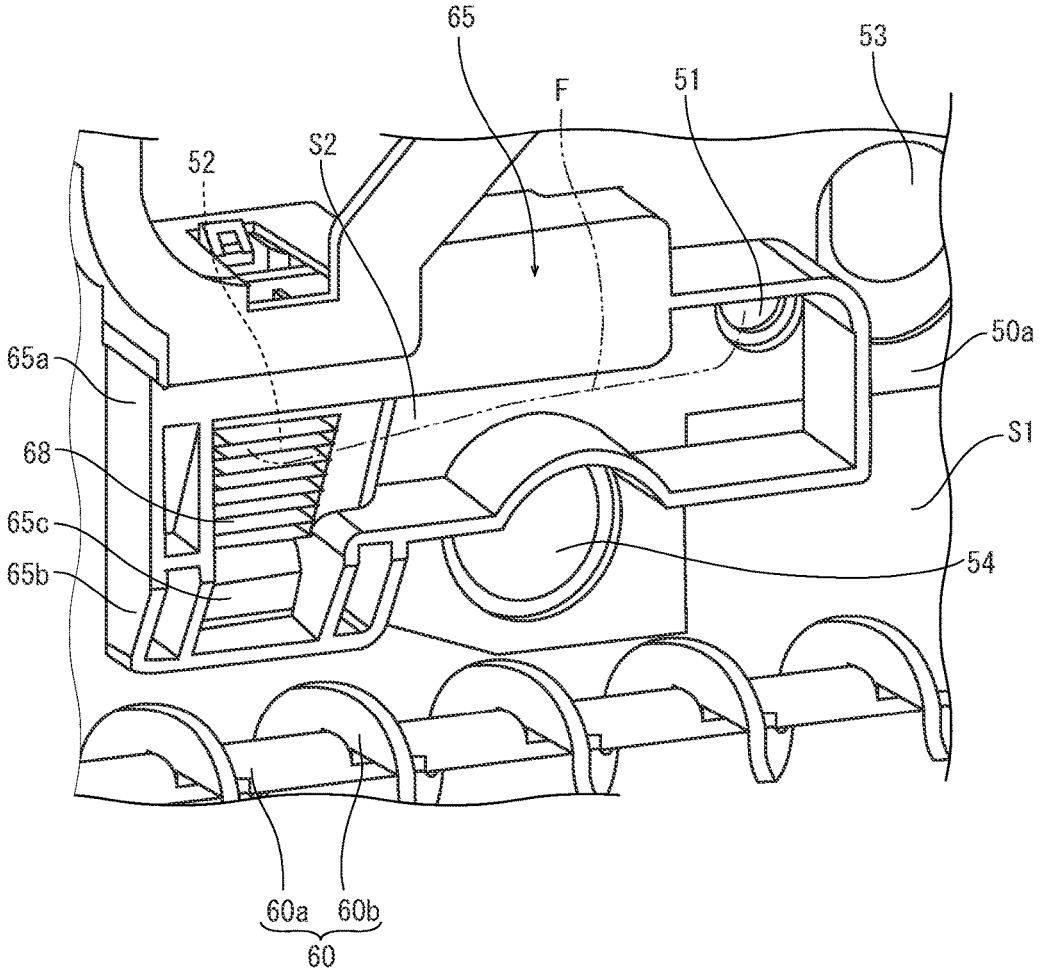
FIG. 6 is a front side perspective view showing an inside of the floating toner collection chamber in the waste toner collecting device according to the embodiment of the present disclosure.
Figure 7:
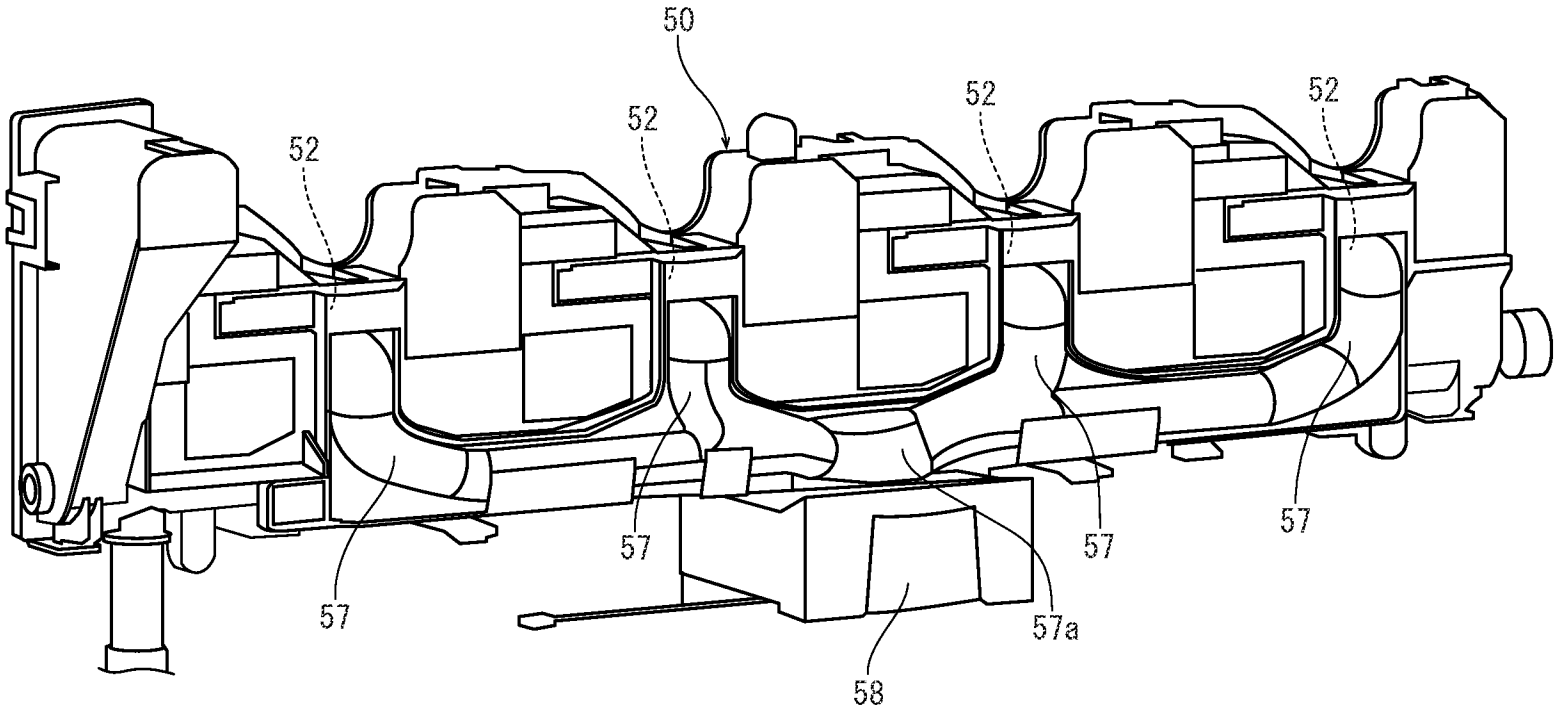
FIG. 7 is a rear side perspective view showing the toner collecting device according to the embodiment of the present disclosure.

With reference to FIGS. 4 to 7, the waste toner collecting device 40 will be described. FIG. 4 is a front side perspective view showing the waste toner collecting device 40. FIG. 5 is a front side perspective view showing a floating toner collection chamber 65. FIG. 6 is a front side perspective view showing a hollow space S2 of the floating toner collection chamber 65. FIG. 7 is a rear side perspective view showing the waste toner collecting device 40.

The waste toner collecting device 40 includes an intermediate collection box 50, a waste toner collection container 90 and floating toner collection chambers 65. The intermediate collection box 50 is disposed on the front side of the image forming parts Pa to Pd. In the intermediate collection box 50, the toner removed by the drum cleaning devices 7*a* to 7*d*, the toner removed by the belt cleaning device 19, the floating toner existing near the development rollers 35 of the developing devices 3*a* to 3*d* and the excessive developer in the developing devices 3*a* to 3*d* is temporarily stored. The waste toner collection container 90 is disposed below the intermediate collection box 50. In the waste toner collection container 90, the toner and developer contained in the intermediate collection box 50 is finally collected. The floating toner collection chambers 65 are provided inside the intermediate collection box 50 so as to correspond to the image forming parts Pa to Pd. In the floating toner collection chambers 65, the floating toner is temporarily stored.

As shown in FIG. 4, the intermediate collection box 50 has a width and a height respectively corresponding to a width and a height of the four image forming parts Pa to Pd, and a predetermined thickness. The intermediate collection box 50 has a base part 50*a* and a lid part 50*b* which forms a horizontally long parallelepiped hollow space S1.

The base part 50*a* has a floating toner receiving opening 51, an exhaust opening 52, a first collected toner receiving opening 53 and a waste developer receiving opening 54 at a position corresponding to each of the four image forming parts Pa to Pd. The floating toner receiving opening 51 and the exhaust opening 52 are positioned side by side in the left-right direction while the floating toner receiving opening 51 on the right side and the exhaust opening 52 on the left side. The first collected toner receiving opening 53 is positioned on the left side of the exhaust opening 52. The waste developer receiving opening 54 is positioned below the floating toner receiving opening 51 and the exhaust opening 52. On a right end portion of the base part 50*a*, a second collected toner receiving opening 55 is formed.

The floating toner receiving opening 51 is connected to the floating toner duct 38 of each of the developing devices 3*a* to 3*d*. The exhaust opening 52 is connected to an exhaust duct 57. As shown in FIG. 7, on a rear face of the base part 50*a*, the exhaust ducts 57 are joined to a center of the base part 50*a* in the left-right direction. On a joint portion 57*a* to which the exhaust ducts 57 are joined, an exhaust fan 58 as an example of an exhaust device is provided.

The first collected toner receiving opening 53 is connected to the discharge opening (not shown) of each of the drum cleaning devices 7*a* to 7*d*. The waste developer receiving opening 54 is connected to the excessive developer discharge opening (not shown) of each of the developing devices 3*a* to 3*d*. The second collected toner receiving opening 55 is communicated with the toner discharge opening (not shown) of the belt cleaning device 19.

On a bottom face of the intermediate collection box 50, a conveying path 50*c* is formed along the left-right direction. The toner and the developer received through the floating toner receiving openings 51, the first collected toner receiving openings 53, the waste developer receiving openings 54 and the second collected toner receiving opening 55 are fallen on the conveying path 50*c* by their own weight.

On the conveying path 50*c*, a conveying screw 60 is rotatably supported. The conveying screw 60 is an example of a conveying member which conveys the stored toner. The conveying screw 60 has a rotating shaft 60*a* and a spiral blade 60*b*. The spiral blade 60*b* is spirally formed around the rotating shaft 60*a* in an axis direction of the rotating shaft 60*a* at constant pitches. To one end portion of the rotating shaft 60*a*, a gear 61 is fixedly attached. The gear 61 transmits rotation force from a driving source (not shown) to the rotating shaft 60*a*. As the driving source, a motor which rotates the feed roller 12*a* may be used, for example. The motor has a clutch which allows the rotating shaft 60*a* to be rotated in a normal direction and a reverse direction.

At a right end portion of a bottom face of the conveying path 50*c*, a connection pipe 62 connected to the waste toner collection container 90 is connected. When rotated in the normal direction, the conveying screw 60 conveys the toner and developer fallen on the conveying path 50*c* rightward in FIG. 4 (in the direction toward the connection pipe 62). The toner and developer is conveyed along the conveying path 50*c* and then collected into the waste toner collection container 90 through the connection pipe 62. The waste toner collection container 90 can be detachably attached to the connection pipe 62. The waste toner collection container 90 has a sensor which detects an amount of the collected toner and developer. When the sensor detects that a predetermined amount of toner and developer is collected, the waste toner collection container 90 is detached from the connection pipe 62 and the collected toner and developer is discarded.

As shown in FIGS. 5 and 6, the floating toner collection chamber 65 has a partition wall 65*a* and a lid part 66. The partition wall 65*a* is stood on the base part 50*a* so as to surround an area containing the floating toner receiving opening 51 and the exhaust opening 52. The lid part 66 covers a space surrounded by the partition wall 65*a*. The partition wall 65*a*, the lid part 66 and the base part 50*a* form a horizontally long parallelepiped hollow space S2. The hollow space S2 is isolated from the hollow space S1 of the intermediate collection box 50. The floating toner collection chamber 65 forms an exhaust path F of the air including the floating toner flowing from the floating toner receiving opening 51 communicated with the floating toner duct 38 to the exhaust opening 52 communicated with the exhaust duct 57.

As shown in FIG. 6, a filter unit 68 is attached to the exhaust opening 52 in a downward inclined posture. The filter unit 68 is an example of a catching installation configured to catch the floating toner from the air sucked in the floating toner duct 38.

Figure 8:
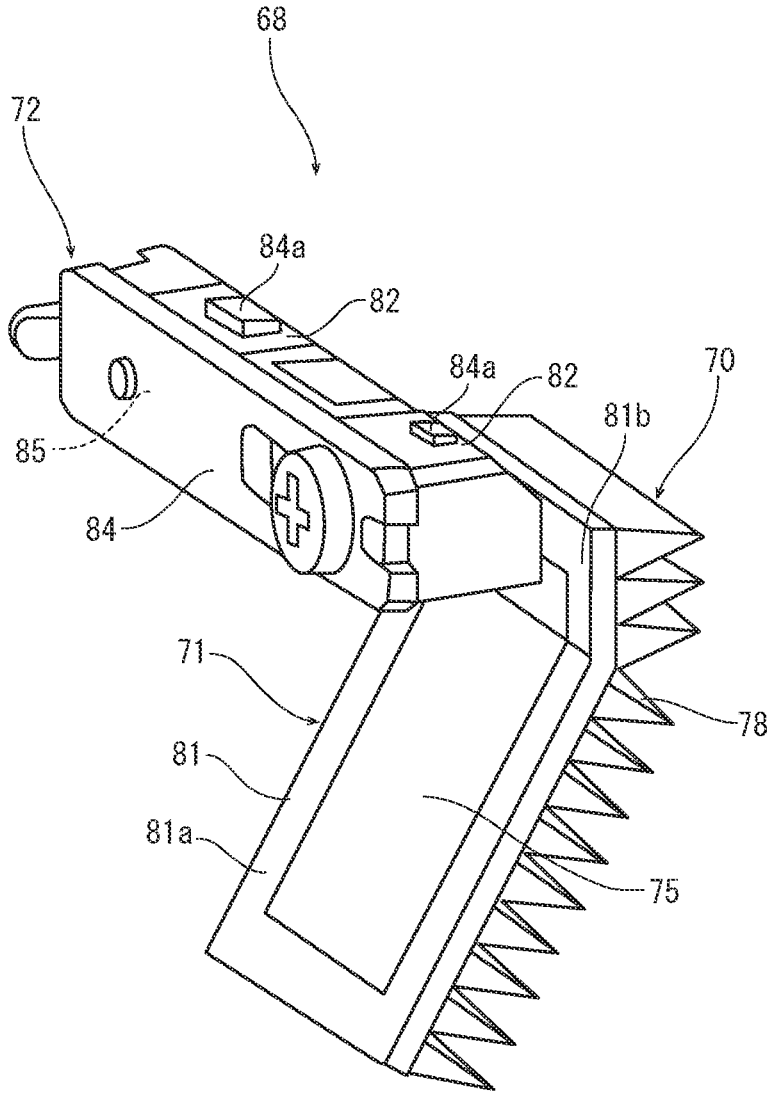
FIG. 8 is a perspective view showing a filter unit of the toner collecting device according to the embodiment of the present disclosure.
Figure 9A:
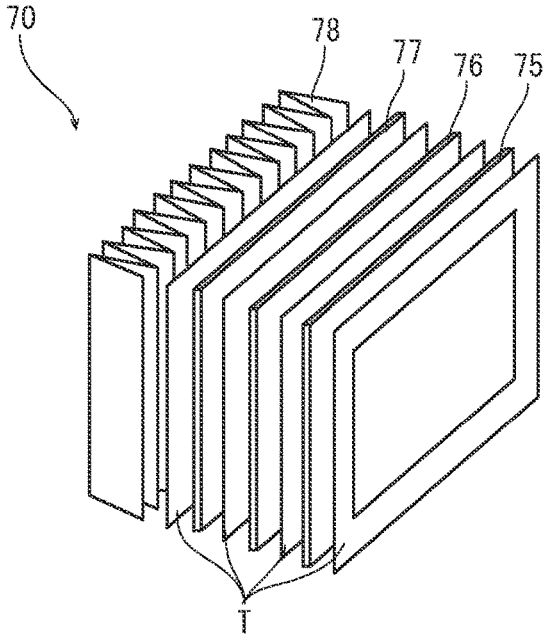
FIG. 9A is a perspective view showing the disassembled filter unit of the toner collecting device according to the embodiment of the present disclosure.
Figure 9B:
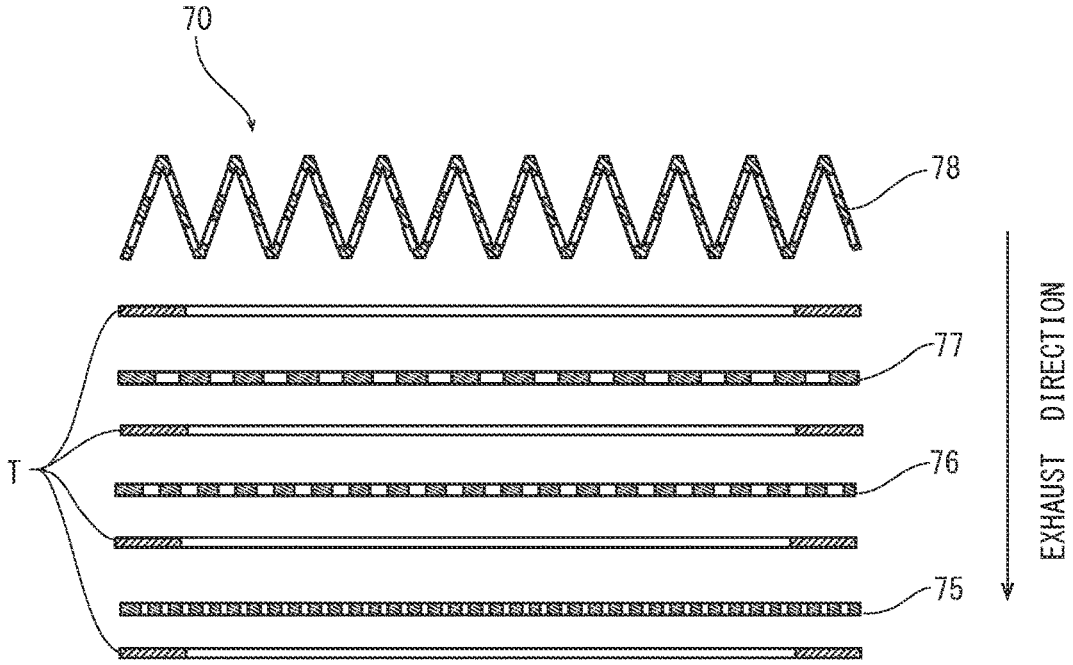
FIG. 9B is a sectional view showing the disassembled filter unit of the toner collecting device according to the embodiment of the present disclosure.

With reference to FIG. 8, FIG. 9A and FIG. 9B, the filter unit 68 will be described. FIG. 8 is a perspective view showing the filter unit 68, FIG. 9A is a perspective view showing the disassembled filter unit 68 and FIG. 9B is a sectional view showing a disassembled filter assembly 70.

As shown in FIG. 8, the filter unit 68 includes a filter assembly 70, a supporting body 71 to which the filter assembly 70 is supported and a vibrator 72 which vibrates the supporting body 71.

As shown in FIG. 9A and FIG. 9B, the filter assembly 70 is formed by overlapping a plurality of filters (a first filter 75, a second filter 76, a third filter 77 and a fourth filter 78 in the present embodiment). Each of the first to the fourth filters 75 to 78 has a different mesh size, and is overlapped in order of increasing the mesh size.

Each of the first to the third filters 75, 76 and 77 has a rectangular plane shape, and the adjacent arranged filters are bonded each other by a rectangular frame shaped double-sided adhesive tape T. The first filter 75 has a smallest mesh size, and has 90% or more of a collection rate for the toner having a particle diameter of 8 μm at a rated air volume, for example. The second filter 76 has a collection rate smaller than the first filter 75. The third filter 77 has a collection rate smaller than the second filter 76.

The fourth filter 78 has a pleated shape formed by folding a rectangular plane shaped filter alternately at mountain folding lines and river folding lines along its shorter direction. The fourth filter 78 has a largest mesh size, and has a collection rate smaller than the third filter 77. The fourth filter 78 is bonded to the third filter 77 by a rectangular frame shaped double-sided adhesive tape T at the river folding lines.

With reference to FIG. 8 again, the supporting body 71 includes a filter attachment part 81 to which the filter assembly 70 is attached and a fixed part 82 which is fixed to the vibrator 72. The supporting body 71 is made of resin or metal.

The filter attachment part 81 is formed into a vertically long rectangular frame shape. The filter attachment part 81 has a lower portion 81*a* and an upper portion 81*b*. The lower portion 81*a* is folded with respect to the upper portion 81*b* at an obtuse angle via a folding line along the shorter direction. Here, one face of the filter attachment part 81 on a side in which the folded lower portion 81*b* is protruded is set as an outer face and the other face opposing to the one face is set as an inner face. The first filter 75 of the filter assembly 70 is bonded to the inner face of the filter attachment part 81 with a rectangular frame shaped double-sided adhesive tape T (refer to FIGS. 9A and 9B). The fixed part 82 extends horizontally from the upper portion 81*b* of the filter attachment part 81.

The vibrator 72 includes a housing 84 having a horizontally long parallelepiped shape and a vibration motor 85 stored in the housing 84. On a side face of the housing 84, two engagement projections 84*a* are formed. To the engagement projections 84*a*, the fixed part 82 of the supporting body 71 is engaged so that the supporting body 71 is fixed to the housing 84. When the vibration motor 85 generate vibration, the vibration is transmitted to the filter assembly 70 through the housing 84 and the supporting body 71 to vibrate the filter assembly 70.

The filter unit 68 is attached to the base part 50*a* so as to close the exhaust opening 52 while the fourth filter 78 of the filter assembly 70 facing the hollow space S2 of the floating toner collection chamber 65 in a downward inclined posture. As described above, because the floating toner collection chamber 65 forms the exhaust path F of the air flowing from the floating toner receiving opening 51 to the exhaust opening 52, the filters of the filter assembly 70 are overlapped in order of decreasing the mesh size from an upstream side to a downstream side in an exhaust direction of the exhaust path F.

As shown in FIG. 5 and FIG. 6, the partition wall 65*a* of the floating toner collection chamber 65 is formed with a protruded portion 65*b* extending downward from below the exhaust opening 52. At a lower corner of the protruded portion 65*b*, a discharge opening 65*c* opened to a downward inclined direction is formed. The discharge opening 65*c* is opened and closed by a discharge door 66*a*, as shown in FIG. 5.

Figure 10A:
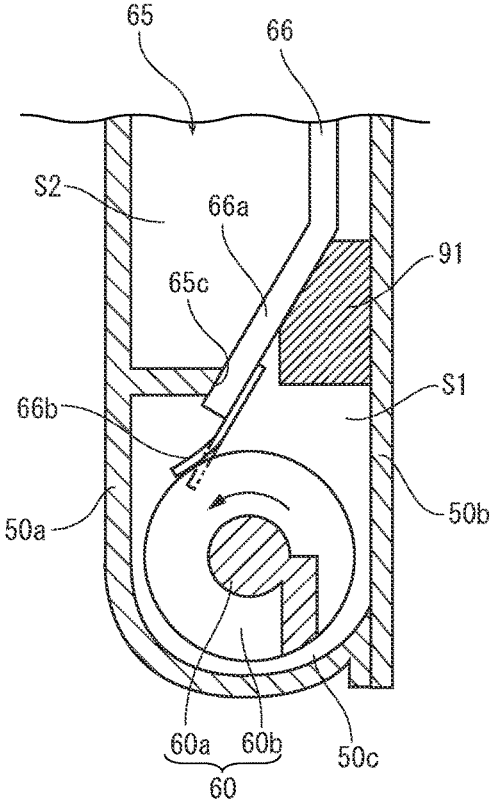
FIG. 10A is a front view showing a discharge door turned into a storage position, in the toner collecting device according to the embodiment of the present disclosure.
Figure 10B:
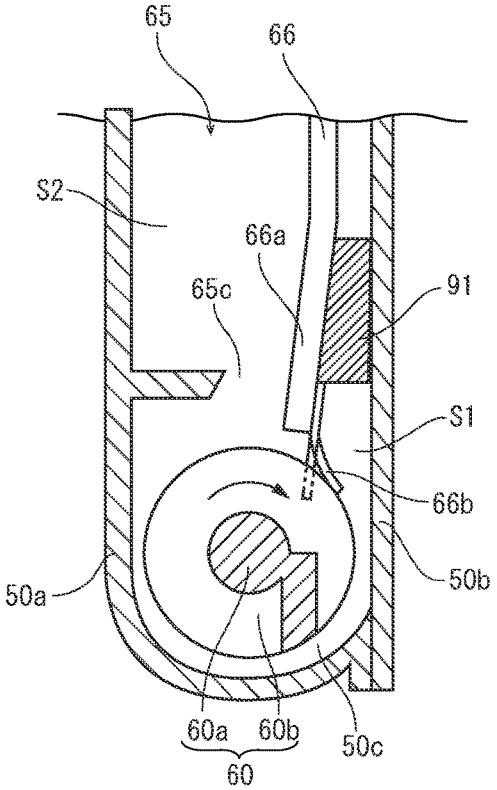
FIG. 10B is a front view showing the discharge door turned into a discharge position, in the toner collecting device according to the embodiment of the present disclosure.

With reference to FIGS. 10A and 10B, the discharge door 66*a* will be described. FIG. 10A shows the discharge door 66*a* turned into a storing position and FIG. 10B shows the discharge door 66*a* turned into a discharge position.

The discharge door 66*a* is connected to the lid part 66. At a tip edge of the discharge door 66*a*, a protruding piece 66*b* is fixedly attached. The protruding piece 66*b* has a width narrower than a pitch of the spiral blades 60*b* of the conveying screw 60, and is made of elastic material, such as PET film.

The discharge door 66*a* is turned between a storage position (refer to FIG. 10A) and a discharge position (refer to FIG. 10B) around an axis approximately parallel to the rotating shaft 60*a* of the conveying screw 60. In the storage position, the discharge door 66*a* closes the discharge opening 65*c*. In the discharge position, the discharge door 66*a* is turned toward the hollow space S1 of the intermediate collection box 50 and opens the discharge opening 65*c*. In the storage position as shown in FIG. 10A, the discharge door 66*a* extends in a lower inclined direction from the lid part 66. In the discharge position as shown in FIG. 10B, the discharge door 66*a* extends from the lid part 66 downward toward the conveying screw 60 supported by the conveying path 50*c*. The discharge door 66*a* is biased by a biasing member 91 to the storage position. The biasing member 91 is made of elastic material, such as urethane foam, for example. The biasing member 91 is interposed between the lid part 50*b* of the intermediate collection box 50 and the discharge door 66*a*.

As shown by a two-dotted line in FIG. 10A, in a state where the protruding piece 66*b* extends in the space between the adjacent spiral blades 60*b*, when the conveying screw 60 rotates in the normal direction (the counterclockwise direction in FIG. 11A) in order to convey the toner and developer fallen on the conveying path 50*c*, the spiral blade 60*b* comes into contact with the protruding piece 66*b*. Then, as shown by a solid line in FIG. 10A, an outer circumferential face of the spiral blade 60*b* presses the protruding piece 66*b* in a rotation direction of the spiral blade 60*b* as the rotating shaft 60*a* rotates. By being pressed by the spiral blade 60*b*, the protruding piece 66*b* is deformed and bent with respect to the discharge door 66*a*. In such a way, the discharge door 66*a* is always turned to the storage position.

On the other hand, when the conveying screw 60 is rotated in the reverse direction, as shown in FIG. 10B, the protruding piece 66*b* is pressed in the reverse direction by the outer circumferential face of the spiral blade 60*b*, and the discharge door 66*a* is turned to the discharge position against biasing force of the biasing member 91. When the discharge door 66*a* is turned to the discharge position, the floating toner stored in the floating toner collection chamber 65 is fallen on the conveying path 50*c* through the discharge opening 65*c*. When the conveying screw 60 is rotated in the normal direction after stopping the rotation in the reverse direction, the discharge door 66*a* is biased by the biasing member 91 to the storage position so that the discharge opening 65*c* is closed.

A toner collecting operation of the waste toner collecting device 40 having the above described configuration will be described. During the image forming operation, as described above, the toner remained on the photosensitive drums 1*a* to 1*d* in the image forming parts Pa to Pd is removed by the respective drum cleaning devices 7*a* to 7*d*. The removed toner is temporarily stored in the intermediate collection box 50 through the first collected toner receiving openings 53. In addition, the toner remained on the intermediate transferring belt 8 after the secondary transferring is removed by the belt cleaning device 19 and then temporarily stored in the intermediate collection box 50 through the second collected toner receiving opening 55. Furthermore, the waste developer discharged through the waste toner discharge openings (not shown) of the developer containers 30 is temporarily stored in the intermediate collection box 50 through the waste developer receiving openings 54. The toner and waste developer received from the receiving openings is fallen on the conveying path 50*c* by their own weight.

In the conveying path 50*c*, the conveying screw 60 is driven by the driving source to be rotated in the normal direction and conveys the fallen toner and developer in the conveying direction (rightward). After being conveyed to a right end of the conveying path 50*c*, the toner and developer is then collected into the waste toner collection container 90 through the connection pipe 62.

On the other hand, when the exhaust fan 58 is driven during the image forming operation, pressure inside each exhaust duct 57 becomes negative, and pressure inside each floating toner collection chamber 65 and each floating toner dust 38 become also negative. As a result, the air containing the floating toner existing near each development roller 35 of the developing devices 3*a* to 3*d* is exhausted through the floating toner duct 38, the floating toner collection chambers 65 and the exhaust ducts 57. In the floating toner collection chamber 65, the floating toner contained in the exhaust air is caught by the filter unit 68. The caught toner is fallen by its own weight and accumulated on upper faces of the partition wall 65*a* and the discharge door 66*a*. On the other hand, the air passing through the filter unit 68 is then discharged through the exhaust ducts 57 outside by the exhaust fan 58.

A floating toner catching mechanism in the filter unit 68 will be described. The air containing the floating toner is first passed through the fourth filter 78 of the filter assembly 70. At this time, the floating toner having a large particle diameter and an aggregated toner are caught by the fourth filter 78. The fourth filter 78 is formed into a pleated shape so as to have a large surface area. Thereby, a large amount of floating toner can be caught. After the floating toner having a large particle diameter is caught by the fourth filter 78, the air is passed through the third filter 77, the second filter 76 and the first filter 75 in the order. During the air passes the filters, the floating toner is gradually caught, and almost all of the floating toner is caught by the first filter 75 having a smallest mesh size and a collection rate of 90% or more for the toner of a particle diameter of 8 μm. Accordingly, the air after passed through the filter unit 68 contains almost no floating toner.

When the vibration motor 85 of the vibrator 72 is driven at a predetermined timing, the filter assembly 70 is vibrated through the housing 84 and the supporting body 71. For example, the vibration motor 85 is controlled so as to repeat stopping and driving at a predetermined period for 10 seconds after stopping of the image forming operation. The vibration allows the toner caught by the fourth filter 78 to be removed from the fourth filter 78 and to be fallen in the floating toner collection chamber 65. In addition, the toner caught by the first to third filters 75, 76 and 77 are also removed from the filters. The toner removed from the filter passes through the lower filter having a larger mesh size than the upper filter, and is finally fallen in the floating toner collection chamber 65.

When an amount of the toner collected in the floating toner collection chamber 65 becomes a predetermined amount, the conveying screw 60 is made to be rotated in the reverse direction for a predetermined period. For example, the conveying screw 60 is made to be rotated in the reverse direction for 2 to 3 seconds for every 1000 sheets. Then, as described above, the spiral blade 60*b* of the conveying screw 60 turns the discharge door 66*a* to the discharge position against the biasing force of the biasing member 91. Thereby, the discharge opening 65*c* is opened so that the floating toner accumulated on the upper faces of the discharge door 66*a* and the others is fallen on the conveying path 50*c*. The fallen toner is conveyed along the conveying path 50*c* by the conveying screw 60 together with the collected toner and waste developer, and collected into the waste toner collection container 90.

In the present embodiment, as described above, because the filter unit 68 is formed by overlapping a plurality of filters. The floating toner having different particle diameters is caught by the filter having the mesh size corresponding to the particle diameter. Accordingly, it becomes possible to collect the floating toner surely and to prolong a life of each filer.

In addition, the filter assembly 70 is made such that the filters are overlapped in order of decreasing the mesh size from the upstream side to the downstream side in the exhaust direction. Accordingly, the floating toner is sequentially caught by the filters, and an amount of the floating toner passing through the filter of a smaller mesh size is decreased so that it becomes possible to prolong the life of each filter. In addition, the first filter 75 having the smallest mesh size has a high collection rate for the toner so that the floating toner can be surely caught. A number of the filters of the filter assembly 70 is not limited to four. The order in which the filters are bonded each other using the double-sided adhesive tapes is not limited to the above described order. The adjacent arranged filters may be bonded by heat-melting or using an adhesive. Alternatively, the filter assembly 70 may be bonded to the supporting body 71.

In addition, the fourth filter 78 having the largest mesh size is formed into the pleated shape so as to have a larger surface area so that a larger amount of floating toner can be caught. As a result, an amount of the floating toner to be caught by the first to third filters 75, 76 and 77 can be made to be smaller.

In addition, the vibration of the filter assembly 70 by the vibrator 72 allows the floating toner caught by the filter assembly 70 to be removed from the filter assembly 70. Thereby, the filter assembly 70 can be prevented from being clogged and an amount of the floating toner entered the exhaust fan 58 can be decreased. Accordingly, it becomes possible to prolong a life of the filter unit 68 and to decrease the frequency of the maintenance work. In addition, performance failure of the exhaust fan 58 and leakage of the toner can be prevented.

In addition, because the discharge opening 65*c* is formed below the filter unit 68, the toner caught by the filter unit 68 can be efficiently fallen to the conveying path 50*c* through the discharge opening 65*c*.

In the present embodiment, the floating toner collection chamber 65 is provided in the intermediate collection box 50 in which the toner removed by the drum cleaning devices 7*a* to 7*d* and the belt cleaning device 19 is temporarily stored. And, the floating toner stored in the floating toner collection chamber 65 can be discharged into the intermediate collection box 50. That is, it is not necessary to provide a floating toner collection container separately from the waste toner collection container 90. Accordingly, a number of replacement work of the collection containers can be reduced compared with a case where the floating toner collection container and the waste toner collection container 90 are separately provided so that the maintenance performance can be improved.

In addition, because it is not necessary to provide a floating toner collection container, enlargement in size of the image forming apparatus 100 can be inhibited. Furthermore, when a detecting sensor which detects the toner collection container being full is provided, only one of the detecting sensor is required so that a configuration of the waste toner collecting device can become simple and cost of it can be reduced.

In addition, the discharge door 66*a* is interfered with the spiral blade 60*b* as the conveying screw 60 is rotated, and turned to open and close the discharge opening 65*c* so that a dedicated tuning mechanism of the discharge door 66*a* for opening and closing the discharge opening 65*c* is not required. As described above, it becomes possible to prolong the life of the filter unit 68 and to automatically discharge the floating toner collected in the floating toner collection chamber 65. Accordingly, the frequency of the maintenance work can be reduced remarkably.

The embodiment disclosed in this disclosure is considered to be illustrative in all points but to be restricted. The scope of the disclosure is shown by the scope of the claims not by the detailed description described above, and contains modification of or within an equivalent meanings of the scope of the claims. For instance, although the above embodiment was described in a case where configurations of the disclosure are applied to the color printer, the disclosure it not limited to the embodiment. The configurations of the disclosure may be applied to various image forming apparatus including a waste toner conveying path through which the waste toner is conveyed and an exhaust path through which the floating toner in the developing device is passed, such as a monochromatic printer, a monochromatic copying machine, a color copying machine, a multifunctional peripheral and a facsimile.

The invention claimed is:

1. A toner collecting device comprising:

an exhaust path through which air containing a floating toner is passed;

a catching installation configured to catch the floating toner from the air passing through the exhaust path;

a floating toner collection chamber in which the floating toner caught by the catching installation is stored;

an intermediate collection box in which the floating toner collection chamber is provided, the intermediate collection box storing a toner removed from an image carrier by a cleaning device;

a waste toner collection container in which the toner stored in the intermediate collection box is collected; and a conveying screw supported on a conveying path provided in the intermediate collection box in a rotatable manner in a normal direction and in a reverse direction, the conveying screw conveying the stored toner toward the waste toner collection container by rotating in the normal direction;

wherein the floating toner collection chamber includes:

a discharge opening opened to an inside of the intermediate collection box; and a discharge door which is interfered with the conveying screw as the conveying screw is rotated, and is turned between a storage position where the discharge opening is closed and a discharge position where the discharge opening is opened, wherein rotation of the conveying screw in the normal direction turns the discharge door into the storage position, rotation of the conveying screw in the reverse direction turns the discharge door into the discharge position so that the floating toner stored in the floating toner collection chamber is discharged into the conveying path through the discharge opening, wherein the catching installation is formed by overlapping a plurality of filters each having a different mesh size, the plurality of filters are overlapped in order decreasing the mesh size from an upstream side to a downstream side in an exhaust direction of the exhaust path, and the filter having a largest mesh size in the plurality of filters is formed into a pleated shape formed by folding a rectangular plane shaped filter alternately at mountain folding lines and river folding lines.

2. The toner collecting device according to claim 1, wherein the filter having a smallest mesh size in the plurality of filters has a collection rate of 90% or more for the floating toner having a particle diameter of 8 μm at a rated air volume.

3. The toner collecting device according to claim 1, wherein the catching installation includes:

a filter assembly formed by overlapping the plurality of filters; and a vibrator which vibrates the filter assembly to make the floating toner caught by the filter assembly to be fallen.

4. The toner collecting device according to claim 3, wherein the catching installation includes a supporting body to which the filter assembly is supported, and the vibrator vibrates the supporting body.

5. The toner collecting device according to claim 1, wherein the floating toner collection chamber has a receiving opening and a discharge opening for the air containing the floating toner, and the exhaust path is formed between the receiving opening and the discharge opening, wherein the catching installation is attached to the discharge opening.

6. The toner collecting device according to claim 5, wherein the catching installation is attached to the discharge opening in a downward inclined posture.

7. The toner collecting device according to claim 1, wherein the discharge opening of the floating toner collection chamber is formed below the catching installation.

8. An image forming apparatus comprising:

an image forming part configured to form an image; and a toner collecting device according to claim 1, which collects a waste toner discharged from the image forming part.

9. A toner collecting device comprising:

an exhaust path through which air containing a floating toner is passed;

a catching installation configured to catch the floating toner from the air passing through the exhaust path, the catching installation being formed by overlapping a OH-al-plurality of filters each having a different mesh size;

a floating toner collection chamber in which the floating toner caught by the catching installation is stored;

an intermediate collection box in which the floating toner collection chamber is provided, the intermediate collection box storing a toner removed from an image carrier by a cleaning device;

a waste toner collection container in which the toner stored in the intermediate collection box is collected; and a conveying screw supported on a conveying path provided in the intermediate collection box in a rotatable manner in a normal direction and in a reverse direction, the conveying screw conveying the stored toner toward the waste toner collection container by rotating in the normal direction;

wherein the floating toner collection chamber includes:

a discharge opening opened to an inside of the intermediate collection box; and a discharge door which is interfered with the conveying screw as the conveying screw is rotated, and is turned between a storage position where the discharge opening is closed and a discharge position where the discharge opening is opened, wherein rotation of the conveying screw in the normal direction turns the discharge door into the storage position and rotation of the conveying screw in the reverse direction turns the discharge door into the discharge position so that the floating toner stored in the floating toner collection chamber is discharged into the conveying path through the discharge opening.

* * * * *